United States Patent [19]

Sakai

[11] Patent Number: 4,780,013

[45] Date of Patent: Oct. 25, 1988

[54] WEB FEED TRACTOR FOR PRINTER

[75] Inventor: Tetsuo Sakai, Fukui, Japan

[73] Assignee: Sakase Kagaku Kogyo Kabushiki Kaisha, Fukui, Japan

[21] Appl. No.: 854,164

[22] Filed: Apr. 21, 1986

[51] Int. Cl.[4] ..... B41J 11/30; B41J 11/34

[52] U.S. Cl. ..... 400/616.2; 16/293; 226/74; 226/86; 226/196; 400/618

[58] Field of Search ..... 400/611, 616, 616.1, 400/616.2, 618; 226/74, 86, 196; 16/293

[56] References Cited

U.S. PATENT DOCUMENTS

| | | | |
|---|---|---|---|
| 3,159,263 | 12/1964 | Goreham | 400/616.2 |
| 3,283,875 | 11/1966 | Davies | 400/616.2 X |
| 3,669,327 | 6/1972 | Dowd | 400/616.3 |
| 3,858,735 | 5/1976 | Wanat | 400/616.2 X |
| 3,917,048 | 11/1975 | Riley | 400/611 |
| 4,111,565 | 9/1978 | Jagger | 400/616.2 X |
| 4,115,014 | 9/1978 | Wood et al. | 400/611 |
| 4,199,091 | 4/1980 | Hubbard | 226/74 |
| 4,344,715 | 8/1982 | Van Horne et al. | 400/616.1 |
| 4,365,905 | 12/1982 | Jung | 400/616.2 X |
| 4,519,723 | 5/1985 | Kusmierz | 400/616.2 X |
| 4,569,468 | 2/1986 | Neer | 400/616.1 X |
| 4,572,418 | 2/1986 | Hirata | 400/608.2 X |
| 4,611,737 | 9/1986 | Hubbard et al. | 400/616.2 X |
| 4,614,287 | 9/1986 | Ueno et al. | 400/616.1 X |
| 4,638,935 | 1/1987 | Wald | 226/74 X |
| 4,642,661 | 2/1987 | Dean | 400/616.2 X |
| 4,650,358 | 3/1987 | Lohrmann et al. | 400/616.2 |
| 4,652,160 | 3/1987 | Lohrmann | 400/616.2 X |

FOREIGN PATENT DOCUMENTS

| | | | |
|---|---|---|---|
| 50718 | 5/1982 | European Pat. Off. | 400/616 |
| 2827125 | 1/1980 | Fed. Rep. of Germany | 400/616.1 |
| 2043 | 1/1980 | Japan | 400/616.1 |
| 161680 | 12/1980 | Japan | 400/616.2 |
| 96880 | 6/1982 | Japan | 400/616.1 |
| 67486 | 4/1983 | Japan | 400/618 |
| 76373 | 4/1985 | Japan | 400/616.1 |
| 198275 | 10/1985 | Japan | 400/616.1 |
| 1337472 | 11/1973 | United Kingdom | 400/616.2 |
| 8503671 | 8/1985 | World Int. Prop. O. | 400/616.2 |

OTHER PUBLICATIONS

IBM Tech. Disc. Bulletin, "Wide Wheel-Based Sprochet with Bidirectional Locking insert for Form-Feed Mechanisms", vol. 28, No. 9, Feb. 1986, pp. 3816-3817.

IBM Tech. Disc. Bulletin "Tractor Clamp Device Cam Lock", Williams, vol. 19, No. 11, Apr. 1977, p. 4114.

IBM Tech. Disc. Bulletin "Anti-Backlash Spring Clamp, Cornell, vol. 22, No. 5, Oct. 1979, p. 1788.

Research Disclosure, "Continuous Form Pin-Feed Tractor Exit Ramp", Kenneth Mason Pub. Ltd. No. 260, Dec. 1985.

*Primary Examiner*—Edgar S. Burr

*Assistant Examiner*—James R. McDaniel

[57] ABSTRACT

A web feed tractor which comprises a frame, a drive gear rotatably mounted in the frame, a cylindrical shaft fastening member mounted on the frame with a portion thereof protruding from the frame, an endless toothed timing belt trained about the frame and drive gear, a cover plate assembly peripherally surrounding the endless belt in peripherally spaced relationship to the belt to define a track of a web to be fed, a web support or guide member positioned adjacent to the endless belt in side by side relationship, a lock ring rotatably mounted on the protruding portion of the shaft fastening member and a switch mechanism positioned in the track of the web so as to be operated by the web as the web passes through the track.

8 Claims, 3 Drawing Sheets

Fig. 2
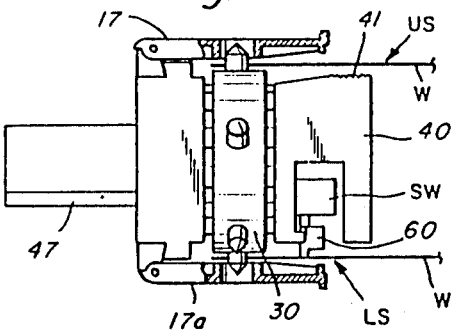
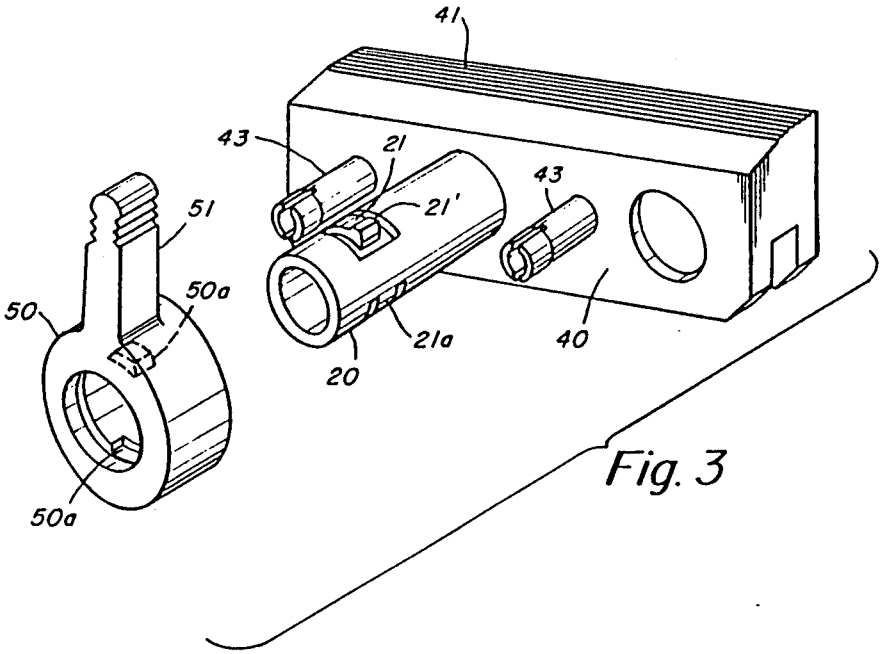
Fig. 3
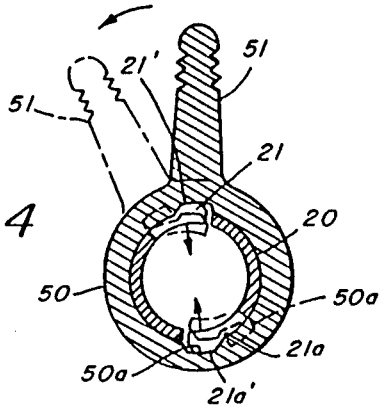
Fig. 4

WEB FEED TRACTOR FOR PRINTER

BACKGROUND OF THE INVENTION

This invention relates to a web feed tractor for a printer and, more particularly, to such a web feed tractor having a web feed stabilization mechanism, a lock means and a switch mechanism which are improved over the corresponding components in prior art web feed tractors.

Prior Art

There have been processed and practically employed a variety of web feed tractors. One of the prior art web feed tractors which is most pertinent to the web feed tractor of the present invention is shown in FIGS. 6 and 7. In the prior art web feed tractor, the endless timing belt B is rotatably supported on the drive shaft D and support shaft S which extend in parallel to each other. The web W is driven by the teeth T on the timing belt B which are in engagement in the marginal perforations, P, P, . . . in the web to feed the web. The cover plate C confines the web within the track thereof so as to prevent the perforations P in the web W from coming off the teeth T of the timing belt B. In order to simultaneously print a number of webs in a stack, when the stacked webs are simultaneously fed, if the feed speed is low, the webs tend to get out of alignment slightly under wind pressure.

In the prior art web feed tractor, the body or frame of the tractor is slidably supported on the support shaft S and drive shaft D which are parallel to each other and the width of the web to be fed and the body can be properly held in a position in conformity with the width of the web. However, the prior art tractor body holding means is not perfectly satisfactory.

Furthermore, various switch mechanisms have been proposed to be incorporated in the prior art web feed tractor. However, such switch mechanisms are complicated in construction and do not positively detect the breakage or the like defect of the web.

SUMMARY OF THE INVENTION

Therefore, the object of the present invention is to provide a novel and improved web feed tractor which can effectively eliminate the disadvantages inherent in the prior art web feed tractors and precisely feed webs in stacks without misalignment.

According to the present invention, a web support or guide member is provided adjacent to a toothed timing belt in side by side relationship and the web guide member has a web support or guide surface extending beyond the marginal edges of the cover plate assembly and provided with a plurality of parallel longitudinal web guide grooves extending in the web feed direction to provide a large track area whereby the web can be fed in a stabilized position without meandering vertically even when the web is fed at high speeds.

Furthermore, according to the present invention, there is provided a holding means for the body or frame of the web feed tractor which holds the tractor body or frame in a proper position in accordance with the width of the web being fed.

In addition, according to the present invention, there is provided a switch mechanism which can positively detect the breakage or the like defect of the web if any.

The switch mechanism can be effectively utilized in the web feed tractor and is simple in construction and positive in operation. That is, according to the present invention, the body or frame of the web feed tractor is slidably mounted on a support shaft and a drive shaft which extend in parallel to each other and are movable in the width of the web to be fed. The teeth on the endless timing belt engage in the marginal perferations in the web to guide the web through the track section defined between the upper run of the timing belt and the first or upper cover plate or web holding plate extending over the belt, invert the web about the transition of the web track and then guide the web through the track section defined between the lower run of the timing belt and the second or lower cover plate or web holding plate extending below the lower run of the timing belt. A limit switch is positioned adjacent to the endless timing belt in side by side relationship in opposition to the second or lower cover plate whereby as the web passes through the lower track section the web applies pressure to the operation member of the limit switch to turn the limit switch on to detect the breakage or the like defect of the web if any.

One object of the present invention is to provide a web feed tractor which comprises a frame, a drive gear rotatably mounted in said frame, and endless toothed timing belt trained about said frame and drive gear, a cover plate assembly peripherally surrounding said frame and drive gear in spaced relationship to said timing belt to define the track of a web between said timing belt and cover plate assembly, a web guide member positioned adjacent to said endless belt in side by side relationship and having a web guide surface provided with a plurality of longitudinal guide grooves extending in the web feed direction.

Another object of the present invention is to provide a lock means for the support shaft which comprises a cylindrical shaft fastening member partially received in the frame with a portion of the member protruding on one side of the frame and a lock ring rotatably mounted on the cylindrical fastening member.

A further object of the present invention is to provide a switch mechanism for the web feed tractor which comprises a limit switch positioned in the lower run of the endless timing belt to be contacted and operated by the web as the web passes through the lower tract section defined between the lower run of the endless timing belt and the cover plate assembly.

The purpose of the present invention is achieved by providing a web feed tractor which comprises a frame having a drive gear mounting through hole, a belt guide stage on one side and a through hole extending through the frame and stage; and drive gear rotatably mounted in said gear mounting hole and supported on a drive shaft extending through said gear; an internally toothed endless timing belt trained about said stage and drive gear and having a plurality of web engaging pins on the outer surface of said belt for engaging in marginal perforations in a web to be fed through said tractor; a cover plate assembly pivoted to said frame and peripherally surrounding said timing belt in spaced relationship to define a web track therebetween, said cover plate assembly including upper and lower plates pivoted to the frame; a web guide member positioned adjacent to one side of said timing belt in side by side relationship and having a web guide surface having width sufficient to extend beyond the marginal edges of said cover plate assembly and provided with a plurality of longitudinal grooves extending in the web feed direction, said web guide member further including two through holes through one of which said drive shaft extends, a support shaft extending through the other of said two through holes in the web guide member and said hole in the frame; a support shaft lock means mounted on said support shaft and including a cylindrical shaft fastening member extending from said frame and mounted on said support shaft, said fastening member being received in said hole in the frame with a portion of the fastening member protruding on the side of the frame opposite from the side of the frame on which said stage is formed and a lock ring rotatably mounted on said protruding portion of the fastening member and having an operation handle extending radially outwardly from the lock ring, said fastening member including a pair of resilient tongues and said lock ring including a pair of recesses in the inner surface for receiving said resilient tongues; and a switch mechanism positioned between the lower run of said timing belt and the lower cover plate and including a limit switch comprising a leaf spring, a downwardly extending contact piece at the free end of said leaf spring and a stopper extending horizontally from said free end of the leaf spring.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

BRIEF DESCRIPTION OF THE DRAWINGS

FIG. 2 is an end elevational view on an enlarged scale in partial section of the web feed tractor of FIG. 1 as seen in the web feed direction when the web feed tractor is assembled;

FIG. 3 is a fragmentary exploded perspective view on an enlarged scale of the support shaft lock means in the tractor of FIG. 1;

FIG. 4 is a cross-sectional view on an enlarged scale of the support shaft lock means in the tractor of FIG. 1 showing the function of the lock means;

PREFERRED EMBODIMENT OF THE INVENTION

Figure 1:
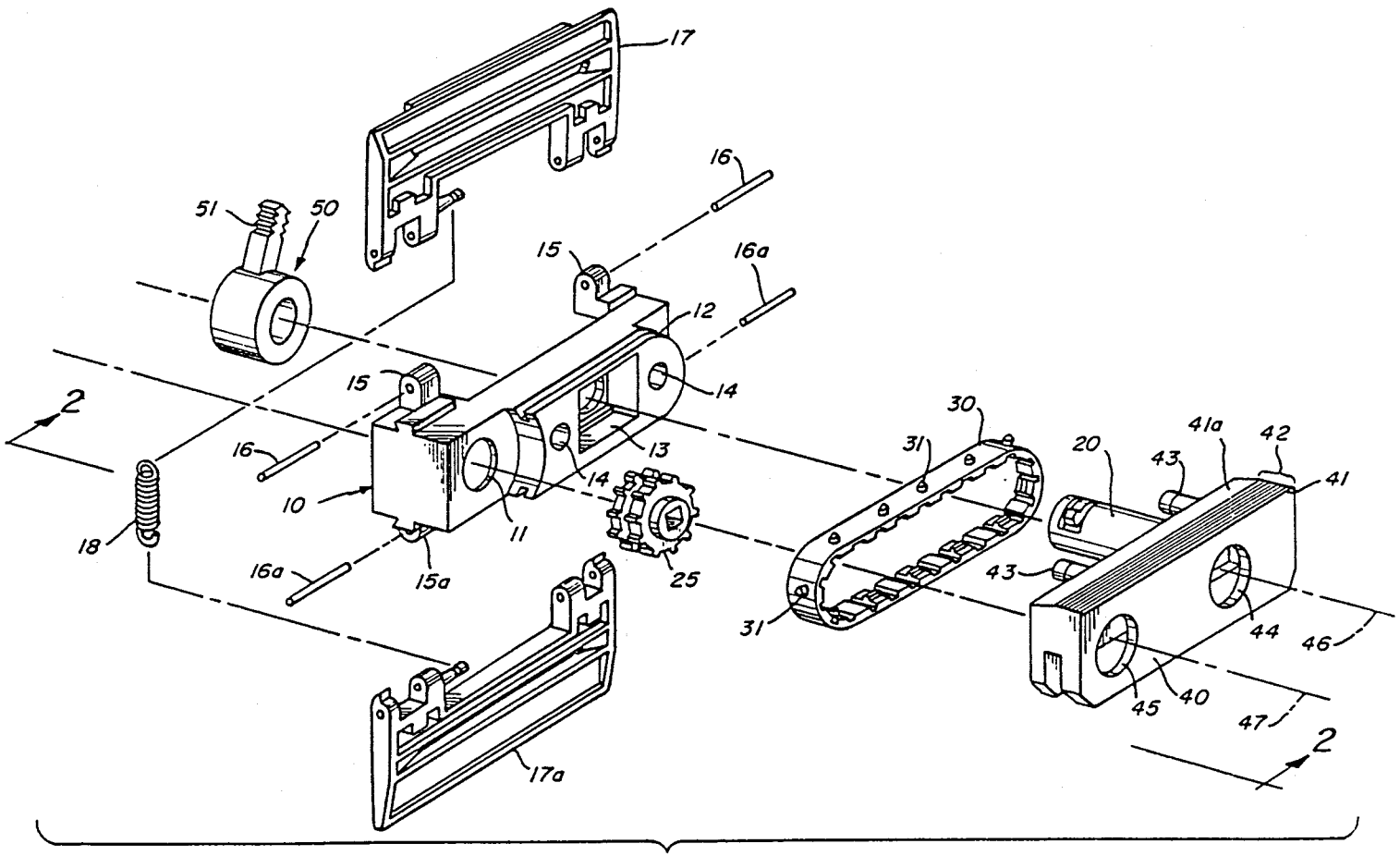
FIG. 1 is an exploded perspective view of the web feed tractor constructed in accordance with the principle of the present invention.

The present invention will be now described referring to the accompanying drawings and, more particularly, to FIG. 1 thereof in which the preferred embodiment of the web feed tractor of the invention is shown in an exploded perspective view. The web feed tractor generally comprisies a frame which is generally shown by reference numeral 10. The frame 10 is provided at one end thereof with a drive gear mounting through hole 11. A stage 12 projects outwardly from one side of the frame 10 and has a rectangular through hole 13 extending through the frame 10 and stage 12 and circular holes 14, 14 on the opposite sides of the rectangular through hole 13 for the purpose to be described hereinafter. A pair of upper ears 15, 15 are provided on the top of the frame 10 and a pair of lower ears **15*a*, 15*a* are provided on the undersurface of the frame. Upper and lower web holding plates 17, 17*a* being inclined at the top edge are pivoted to the ears 15, 15*a*, respectively, by means of upper and lower pivot pins 16, 16*a*, respectively. A coil spring 18 is anchored at the opposite ends thereof to the upper and lower web holding plates 17, 17*a* so as to resiliently bias the upper and lower web holding plates 17, 17*a* towards each other. A cylindrical support shaft fastening member 20 (see FIG. 3) is a part of the web support member 40 and has a pair of upper and lower resilient fastening tongues 21, 21*a* provided on the fastening member 20. The tongues are formed by cutting away a portion of the periphery of the fastening member 20. The fastening member 20 is fitted in the rectangular through hole 13 in the frame 10 with the fastening tongues 21, 21*a* protruding from the other side of the frame 10. A drive gear 25 is mounted in the gear mounting hole 11 in the frame 10 by means of a drive shaft of the gear (not shown) which will be described hereinafter. Driving gear to be used for this invention can be modified to the bobbin type, if it is needed. An internally toothed endless belt 30 is trained about the stage 12 and drive gear 25 and has a plurality of web engaging pins 31 in a single longitudinal row on the outer surface of the belt for engaging in the marginal perforations in a continuous web W (FIG. 2) to feed the web as the gear 25** is driven.

Reference numeral 40 denotes a web guide or support member or plate positioned adjacent to the opposing side of the endless timing belt 30 in side by side relationship and forming a web track having the configuration corresponding to that of the track for the endless belt 30 to be formed by the stage 12 and drive gear 25. The web supporting upper surface 41 of the web support member 40 is formed with three parallel longitudinal grooves 42, 42, 42, and the surface 41 being inclined at its inside edge **41*a*. The web support member 40 is further provided with laterally spaced through holes 44 and 45. A support shaft 46 (shown by a dashed line in FIG. 1) extends through the hole 44 in the web support member 40, the cylindrical support shaft fastening member 20 with the leading end of the shaft protruding on the above-mentioned other side of the frame 10. The drive shaft 47 (shown by a dashed line in FIG. 1) on which the drive gear 25 is mounted extends through the hole 45 in the web support member 40 and is drivingly connected to a drive source (not shown). A lock ring 50 is rotatably fitted on the protruding leading end of the support shaft 46 riding on the fastening tongues 21, 21*a* and has a handle 51 extending radially outwardly from the ring 50 for rotating the ring 50. When the ring 50 is rotated in one direction, the ring presses down the fastening tongues 21, 21*a* to thereby lock the support shaft 46 and when the ring is rotated in the opposite direction, the ring releases the fastening tongues to thereby unlock the support shaft. Two laterally spaced mounting bars 43, 43 project from the side of the web support member or plate 40 facing the frame 10 and are received in the holes 14, 14 extending through the frame 10 and stage 12 to thereby secure the member 40 to the frame 10. When member 40 and the frame 10 are connected, the width of the endless belt has an allowance for the distance between the member 40 and the frame 10. The web support member 40 is recessed at an area between the mounting bars 43 for receiving a limit switch SW (which will be described hereinafter) therein (see FIGS. 2 and 3**).

The peripheries of the endless timing belt 30 and of the web support member or plate 40 are covered by the above-mentioned web holding plates 17, 17*a* pivoted to the ears 15, 15*a*, respectively in peripherally spaced relationship.

In the web feed tractor having the components arranged as mentioned hereinabove, in operation, the web W is transported by the timing belt 30 through the lower track section LS (FIG. 2) defined between the lower web holding plate 17*a* and the opposing lower run of the endless timing belt 30 and then through the upper track section US (FIG. 2) defined between the upper web holding plate 17 and the opposing upper run of the timing belt 30 after having been inverted about the transition between the lower and upper track sections.

According to the present invention, since the upper surface 41 of the web support plate of member 40 provides a web support area wider than that provided by the corresponding member in the prior art web feed tractor and the web support member upper surface 41 is formed with the longitudinal grooves 42, the web W can be positively fed in its stabilized position without being sucked to the support surface 41 as the web is transported by the web feed tractor of the invention.

As should be clear from the foregoing description of the preferred embodiment of the web feed tractor of the invention, since the web support member 40 is disposed adjacent to the toothed timing belt 30 in side by side relationship, the upper surface 41 of the member 40 provides a wide area for supporting the undersurface of the web W and the longitudinal grooves 42 extending in the web feed direction in the web support member upper surface minimize various frictions including electrostatic friction which would be generated as the web slides on the wide surface 41 of the web support member 40, the web can be fed under a quite stabilized condition. When a number of webs in a stack are printed, even if the webs are fed at high speeds, the webs would not meander under winding pressure. The meandering of the webs leads to improper printing.

Referring now to FIG. 3 of the accompanying drawings in which the support shaft lock means of the web feed tractor of the invention is shown in detail, the free end of the resilient tongue 21 or 21*a* is formed with a convexed tip 21' or 21*a'* and the inner periphery of the lock ring 50 is formed with recesses 50*a*, 50*a* for resiliently receiving the convexed tips 21' and 21*a'*, respectively. The fastening member 20 is freely mounted on the support shaft 46 and when the lock ring 50 is rotated in the arrow direction in FIG. 4, the convexed tips 21', 21*a'* are removed out of the associated recesses 50*a*, 50*a* in the lock ring 50 and abut against the inner periphery of the ring 50 whereby the tips 21', 21*a'* of the resilient tongues 21, 21*a* are pressed radially inwardly as shown by the dashed lines in FIG. 4. As a result, the resilient tongues 21, 21*a* are pressed against the support shaft 46 to firmly lock the shaft 46 relative to member 40. In order to release the support shaft 46, the lock ring 50 is rotated in the direction opposite from the arrow direction whereupon the convexed tips 21', 21*a'* of the resilient tongues 21, 21*a* snap in the recesses 50*a*, 50*a* in the lock ring 50 to thereby release the support shaft 46.

As should be clear from the foregoing description of the support shaft lock means, according to the present invention, when the resilient tongues 21, 21*a* are pressed down and released by the rotation of the lock ring 50 in one and the opposite directions, the support shaft 46 can be positively locked and unlocked, respectively. Thus, the support shaft lock means of the invention is quite reliable.

Figure 5:
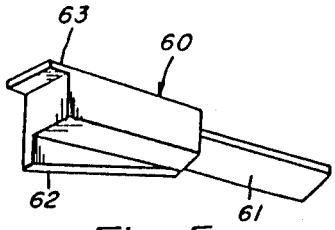
FIG. 5 is a fragmentary perspective view of the limit switch operation member in the switch mechanism of FIG. 2.
Figure 6:
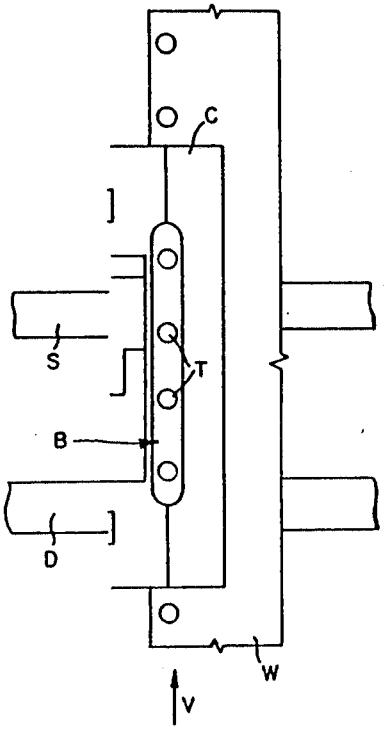
Fig. 6 (PRIOR ART)
FIG. 6 is a schematic plan view of a prior art web feed tractor.
Figure 7:
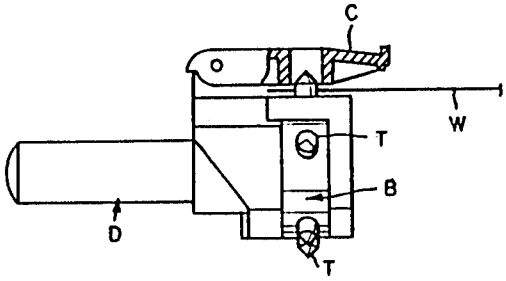
Fig. 7 (PRIOR ART)
FIG. 7 is an end elevational view of the prior art web feed tractor of FIG. 6 as seen in the arrow direction V therein.

Now reference is being made to FIGS. 2 and 5 of the accompanying drawings in which the switch mechanism incorporated in the web feed tractor of the invention is shown. As mentioned hereinabove, the limit switch SW is housed in the recess in the one side of the web support member 40 and includes an operation member 60. The operation member 60 of switch SW is positioned facing the lower web holding plate 17*a* and comprises a leaf spring 61, a friction contact piece 62 provided at the leading end of the leaf spring and downwardly inclining in the web feed direction and a stopper 63 extending horizontally from the leading end of the leaf spring 61.

With the arrangement of the parts of the limit switch SW, while the web W is passing through the lower track section LS defined between the lower run of the toothed timing belt 30 and the web holding plate 17*a*, the operation member 60 is contacted and pushed up by the web W to thereby turn the limit switch SW on so as to detect the breakage or the like defect of the web if any.

As should be clear from the foregoing description of the operation of the limit switch, according to the present invention, since the lower web holding plate 17*a* is provided in opposition to the lower run of the toothed timing belt 30 to define the lower track section LS through which the web W is guided and the operation member 60 is contacted and pushed up by the web W as the web is guided through the lower track section LS to thereby turn the limit switch on, the limit switch can positively detect the breakage or the like defect of the web if any. After the web W has cleared the lower track section LS, the operation member 60 is released from the force which pushes the member 60 up and moves down to turn the limit switch SW off.

Although the present invention has been described with reference to the preferred embodiment thereof, the embodiment described herein is for illustration purpose only and not in limitation thereof. Also the scope of the present invention is defined in the appended claims and will not be limited by description of the preferred embodiment. Accordingly, it will be understood that all changes and modifications within the scope of the appended claims fall within the true spirit and scope of the present invention.

What is claimed is:

1. A web feed tractor comprising:

a frame having a drive gear mounting through hole therein, a belt guide stage on one side thereof, and a supprt shaft receiving through hole extending through the frame;

a drive gear rotatably mounted in said gear mounting hole and supported on a drive shaft;

an internally toothed endless timing belt trained about said stage and drive gear, said timing belt having a plurality of web engaging pins on an outer surface thereof for engaging in marginal perforations of a web to be fed through said tractor;

a cover plate assembly pivotally mounted to said frame and peripherally surrounding said timing belt in spaced relationship to define a web track therebetween, said cover plate assembly including upper and lower cover plates pivoted to said frame;

a web guide member positioned adjacent to one side of said timing belt in side by side relationship therewith and having a web guide surface having a width sufficient to extend beyond marginal edges of said cover plate assembly and having a plurality of longitudinal grooves extending in the web feed direction, said web guide member further including two through holes through one of which said drive gear shaft extends;

a support shaft extending through the other of said two through holes in the web guide member and also extending through said support shaft receiving hole in said frame;

a support shaft lock means mounted on said support shaft, said support shaft lock means including a cylindrical shaft fastening member mounted on said support shaft, a portion of said fastening member extending through said support shaft receiving hole of said frame and protruding on one side of said frame with a protruding portion of said fastening member protruding on the side of said frame opposite from the side of said frame on which said stage is formed, and a lock ring rotatably mounted on said protruding portion of said fastening member and having an operation handle extending substantially radially outwardly from said lock ring, said lock ring having an inner surface surrounding at least a portion of an outer surface of said fastening member, said fastening member including at least one resilient tongues and said lock ring including at least one recess in said inner surface thereof for receiving said at least one resilient tongue therein; and a switch mechanism positioned between the lower run of said timing belt and the lower cover plate, said switch mechanism comprising a limit switch which includes a leaf spring having a free end, a downwardly extending contact piece at said free end of said leaf spring and a stopper extending from said free end of said leaf spring.

2. The web feed tractor of claim 1, wherein said stopper extends substantially horizontally from said free end of said leaf spring.

3. The web feed tractor of claim 1, wherein in said at least one resilient tongue of said support shaft lock means is formed by cutting away a portion of a peripheral wall of said protruding portion of said shaft fastening member.

4. The web feed tractor of claim 3, wherein said at least one resilient tongue has a convex portion thereon which is selectively received in said at least one recess in said inner surface of said lock ring, said fastening member being locked to said support shaft when said convex portion is out of a respective recess, and being movable relative to said support shaft when said convex portion is received in a recess of said lock ring.

5. The web feed tractor of claim 1, wherein said fastening members includes at least two of said resilient tongues, and said lock ring includes at least two recesses in said inner surface thereof for respectively receiving said at least two resilient tongues therein.

6. The web feed tractor of claim 5, wherein said stopper extends substantially horizontally from said free end of said leaf spring.

7. The web feed tractor of claim 5, wherein in said resilient tongues of said support shaft lock means are formed by cutting away a portion of a peripheral wall of said protruding portion of said shaft fastening member.

8. The web feed tractor of claim 7, wherein said resilient tongues each have a convex portion thereon which is selectively received in a respective recess in said inner surface of said lock ring, said fastening member being locked to said support shaft when said convex portions are out of a respective recess, and being movable relative to said support shaft when said convex portions are received in a respective recess of said lock ring.

* * * * *

UNITED STATES PATENT AND TRADEMARK OFFICE

CERTIFICATE OF CORRECTION

PATENT NO. : 4,780,013

DATED : October 25, 1988

INVENTOR(S) : T. SAKAI

It is certified that error appears in the above-identified patent and that said Letters Patent is hereby corrected as shown below:

In the title page, before "ABSTRACT", insert

-- Attorney, Agent or Firm - Frishauf, Holtz, Goodman & Woodward --.

Signed and Sealed this

Eleventh Day of September, 1990

*Attest:*

HARRY F. MANBECK, JR.

*Attesting Officer*

*Commissioner of Patents and Trademarks*